US009964315B1

(12) United States Patent
Ziehm

(10) Patent No.: US 9,964,315 B1
(45) Date of Patent: May 8, 2018

(54) WATER CONSERVATION VIA CONVECTIVE CIRCULATION

(71) Applicant: Raymond G. Ziehm, Littleton, CO (US)

(72) Inventor: Raymond G. Ziehm, Littleton, CO (US)

( * ) Notice: Subject to any disclaimer, the term of this patent is extended or adjusted under 35 U.S.C. 154(b) by 0 days. days.

(21) Appl. No.: 15/429,254

(22) Filed: Feb. 10, 2017

Related U.S. Application Data

(60) Provisional application No. 62/311,040, filed on Mar. 21, 2016.

(51) Int. Cl.
*F24D 17/00* (2006.01)
*E03B 7/04* (2006.01)

(52) U.S. Cl.
CPC ..... *F24D 17/0078* (2013.01); *E03B 7/045* (2013.01); *Y10T 137/6497* (2015.04); *Y10T 137/7871* (2015.04)

(58) Field of Classification Search
CPC ..... Y10T 137/6497; Y10T 137/7871; Y10T 137/7873; Y10T 137/85962; E03B 7/045; F24D 17/0078
See application file for complete search history.

(56) References Cited

U.S. PATENT DOCUMENTS 2,842,155 A * 7/1958 Peters ..... G05D 23/1326 122/13.3
4,286,573 A * 9/1981 Nickel ..... F24H 9/124 122/14.31
5,323,803 A * 6/1994 Blumenauer ..... E03C 1/02 122/13.3
5,518,022 A * 5/1996 Ziehm ..... F24D 17/00 122/13.3
5,622,203 A * 4/1997 Givler ..... F24D 17/0078 122/13.3
5,819,785 A * 10/1998 Bardini ..... F24D 17/00 122/13.3
6,182,683 B1 * 2/2001 Sisk ..... F24D 17/0078 137/337
8,534,310 B1 * 9/2013 Ziehm ..... E03B 7/045 137/337

* cited by examiner

*Primary Examiner* — Kevin Murphy

(74) *Attorney, Agent, or Firm* — Mueller Law, LLC; Jerry K. Mueller, Jr.

(57) ABSTRACT

Disclosed is a two-way check/bypass valve assembly connected between the hot and cold-water standpipes under the sink that allows convective circulation of hot water from an existing water heater, through the existing hot water distribution pipes, through the valve assembly to the cold water standpipe, through the existing cold water standpipe and distribution pipes, and back into the water heater. The convective water flow is induced by the temperature difference between the hot water in the pipe rising above the water heater, and the slightly cooled, and denser, water flowing back down into the water heater. The valve will allow this low circulation water flow so long as both hot and cold faucets at the outlet are closed, and will prevent any cross flow between the hot and cold pipes under the sink when either the hot or cold faucet is opened.

6 Claims, 2 Drawing Sheets

WATER CONSERVATION VIA CONVECTIVE CIRCULATION

CROSS-REFERENCE TO RELATED APPLICATIONS

None.

STATEMENT REGARDING FEDERALLY SPONSORED RESEARCH

Not applicable.

BACKGROUND

This disclosure relates to stopping the waste of water while waiting for hot water to arrive at remote faucets after the faucet has been opened. Many engineers and water technicians have determined that the average American home wastes about 10,000 to 15,000 gallons of water annually while running cooled water down the drain before hot water arrives at the sink. The wait time required varies based upon the length and diameter of the distribution pipe from the heater to the sink. In many homes the wait can be three minutes or more, during which time six or more gallons of potable water are wasted. FIG. 1 shows measured data relating how the wait time for a conventional system is essentially eliminated in a hot water system after installation of convective hot water circulation.

Test data in FIG. 2 show that water in a ½-inch diameter copper pipe in a 70° F. ambient environment will cool from 120° to 90° in 30 minutes; thus, the potential for 20 to 30, or more, wait and waste cycles per day exists in the home with multiple plumbing branches and outlets. Water at 90° F. is not considered warm enough for personal use.

This waste of water can no longer be tolerated in our society, as water shortages already exist across the country, and water departments have implemented many user conditions restrictions due to drought. The United States government initiated a water conservation program in 1994 with the introduction of low flow toilets and shower heads that have proven to be very unpopular with the public, and are often disabled. Rapid hot water circulation is the only residential water conservation system that people will gladly use if it can be easily installed and available at a reasonable cost. Systems using electrically driven pumps have been available for several years however their complexity and extremely high cost plus the requirement for professional installation have significantly limited their acceptance. They also require electrical power outlets not normally available in appropriate locations resulting in additional cost.

Convective circulation is a natural process responding to the laws of physics. The system is simple in design, yet sophisticated in concept. It is extremely reliable and operated by gravity, which has never failed. This system design can easily be installed by most homeowners, and needs no power or gas. The present disclosure is an improvement over the convective circulation system disclosed in U.S. Pat. No. 5,331,996, which it is estimated that almost 28,000 of its system have saved three billion gallons of water since 1996, and are currently saving 270 million gallons per year for homeowners happy with almost instant hot water. The simplicity of this disclosure results in a significant reduction in cost to procure and install.

BRIEF SUMMARY

The present disclosure provides a solution to this waste of water and time by a means the public can afford and enjoy the benefit of having hot water two to three seconds after opening the faucet. Hot water circulation also avoids the waste of the heat once contained in the wasted water of a standard system, plus the need to heat water entering from the street at about 50° F. to replace the wasted water in the system. Water circulating in a convective system re-enters the heater at about 100°, meaning most of its heat is conserved. Simple slip-on insulation on the hot water distribution lines will increase the temperature of the returning water. Contrary to some opinions, our thermal tests and analyses have shown that the heat loss for a circulating system is about one half that of a system without circulation that experiences 25 wait and waste cycles per day. This system provides the opportunity to enjoy the convenience of rapid hot water and the conservation of water at the same time.

The disclosed system eliminates two major brass plumbing tees, two smaller brass connectors, and four internal parts compared to the system of U.S. Pat. No. 8,534,310 with no impact upon hot water performance. Additionally, an average homeowner can simply install the present system.

The disclosed convective hot water circulation system, then, includes a water heater to generate a flow of hot water to one or more hot water taps in flow communication with the water heater through one or more hot water distribution lines, a flow of cold water into the water heater; a flow of cold water to water taps located in adjacency to the hot water taps; and a two-way check/bypass valve interposed in one of the hot water distribution lines in adjacency to a designated hot water tap. The two-way check/bypass valve is composed of a valve body; a hot water flow in the valve body to the designated hot water tap; a cold water flow in the valve body to a designated cold water tap located in adjacency to the designated hot water tap; a hot water poppet and valve seat pair; a cold water poppet and valve seat pair; and a cavity within the valve body permitting the hot water flow into the valve body to flow into the cold water flow to the valve body when both the hot water tap and the cold water tap are closed.

BRIEF DESCRIPTION OF THE DRAWINGS

For a fuller understanding of the nature and advantages of the present method and process, reference should be had to the following detailed description taken in connection with the accompanying drawings, in which.

The drawings will be described in greater detail below.

DETAILED DESCRIPTION

Figure 1:
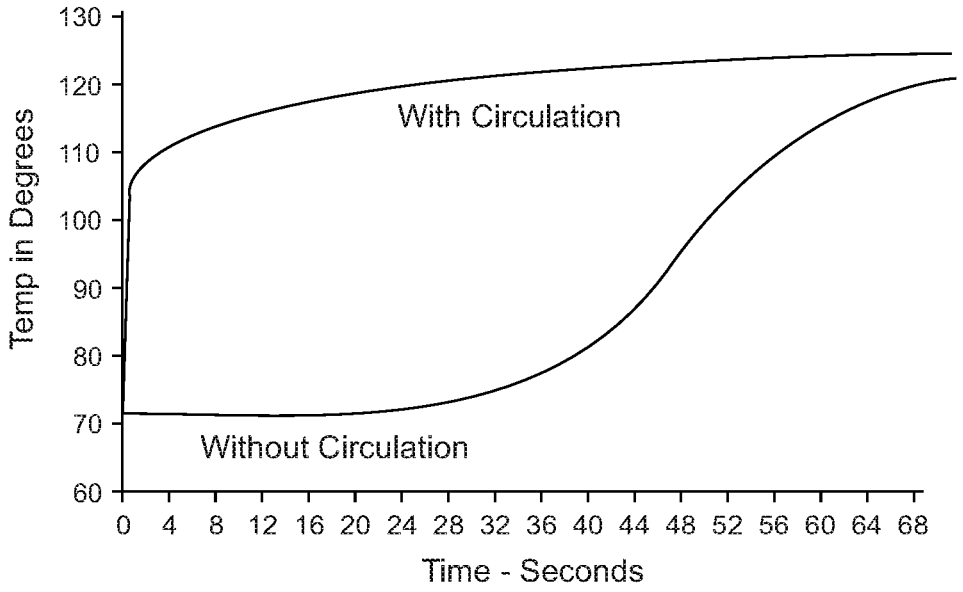
FIG. 1 graphically illustrates the temperature/time profile of a convective circulation system versus a standard system without circulation.
Figure 2:
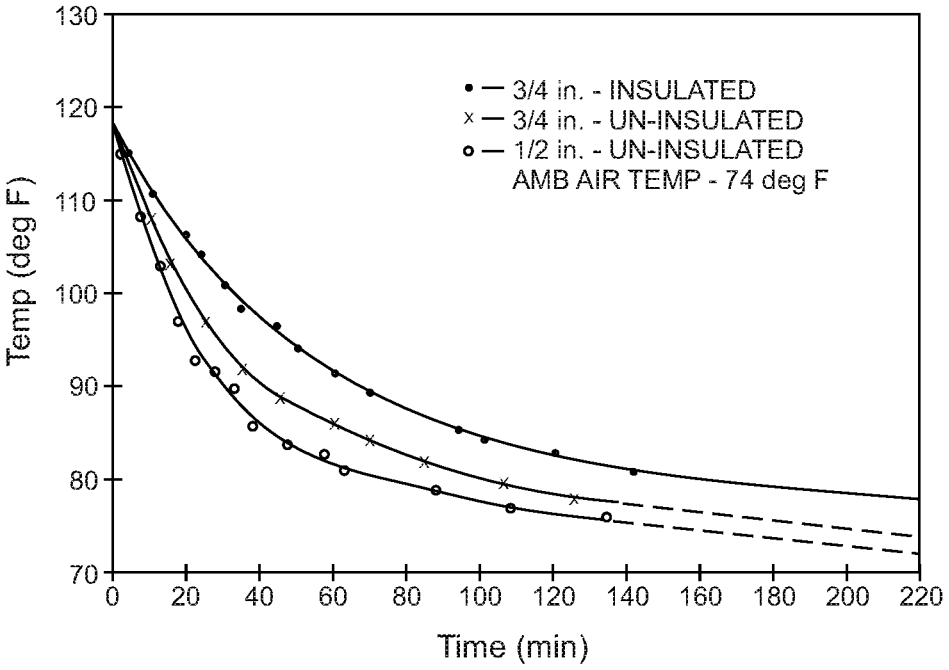
FIG. 2 graphically illustrates the cooling rate of water in typical water pipes without circulation.
Figure 3:
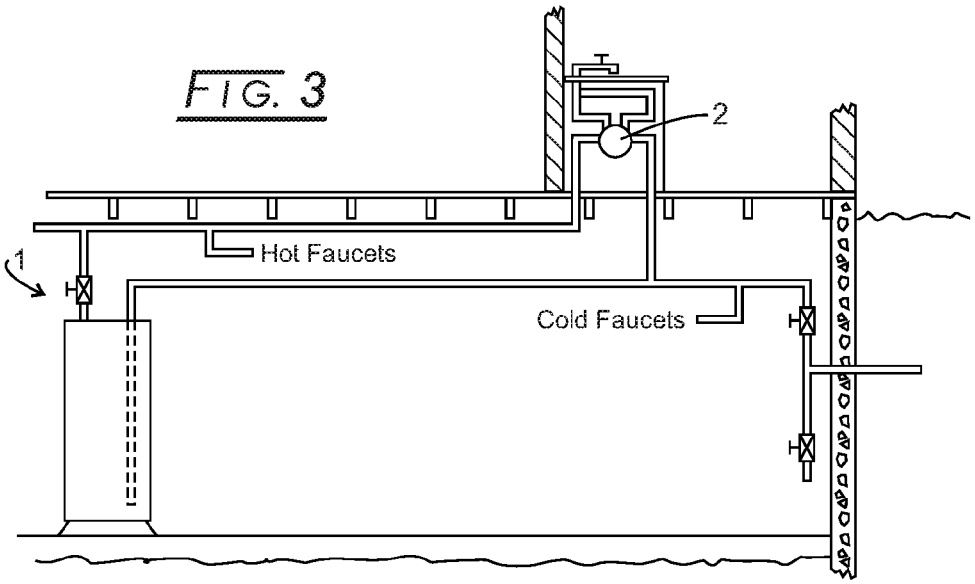
FIG. 3 is a schematic diagram of the convective hot water circulation system of this disclosure.
Figure 4:
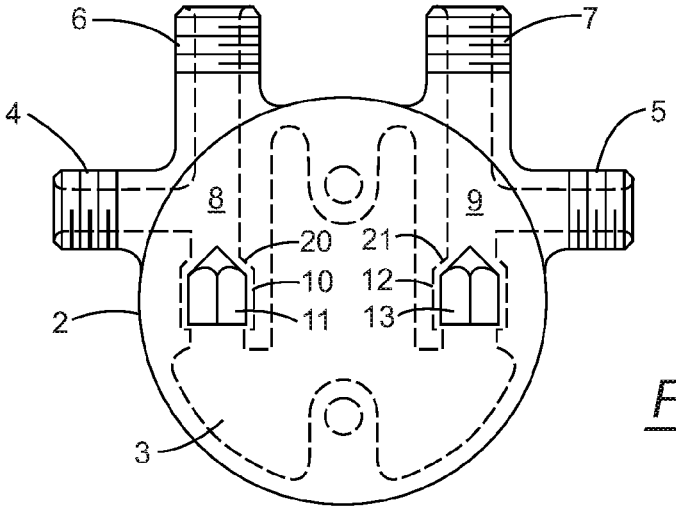
FIG. 4 is a sectional drawing of the disclosed two-way check/bypass valve showing internal parts and water flow passages.

A convective circulation system for rapid hot water in a typical home is shown in FIG. 3. It is composed primarily of the existing water heater and delivery system, 1, common in most American homes, plus the addition of the new two-way check/bypass valve, 2. FIG. 4 shows one embodiment of many possible shapes and designs for a welded plastic valve body, 2, including an internal cavity, 3, and connection means. Externally, check/bypass valve 2 has a hot water inlet connector, 4, and a cold-water inlet connector, 5, both connectors compatible with standard plumbing convention. Check/bypass valve 2 also has a hot water outlet connector, 6, and a cold-water connector, 7, such connectors also are compatible with standard plumbing convention. All connectors can be threaded.

Internal cavity 3 contains a hot water flow path, 8, from hot water inlet connection 4 to hot water outlet connection 6; and a cold-water flow path, 9, from cold-water inlet connection 5 to cold water outlet connection 7. Cavity 3 also contains a hot water valve channel, 10, that houses a movable hot water valve poppet, 11, and a valve seat, 20, leading to hot water flow path 8. Cavity 3 also contains a cold-water valve channel, 12, that houses a cold water movable valve poppet, 13, and a valve seat, 21, leading to cold water flow path 9. Cavity 3 serves as the flow path between the hot and cold valve channels. The shape of the channels and poppets is not important. To minimize material shrinkage and distortion during the molding process, a round poppet located in a square channel is advantageous.

Connectors to the water supply under the sink, 14 and 15, are standard plumbing connectors (e.g., flexible hoses), as are the existing standard plumbing connectors, 18 and 19, (e.g., flexible hoses), normally permanently attached to two faucets. The material of welded plastic valve body 2 is a water compatible plastic, and the poppets are of a similar plastic with a specific gravity slightly above 1.0.

System Operation

Figure 5:
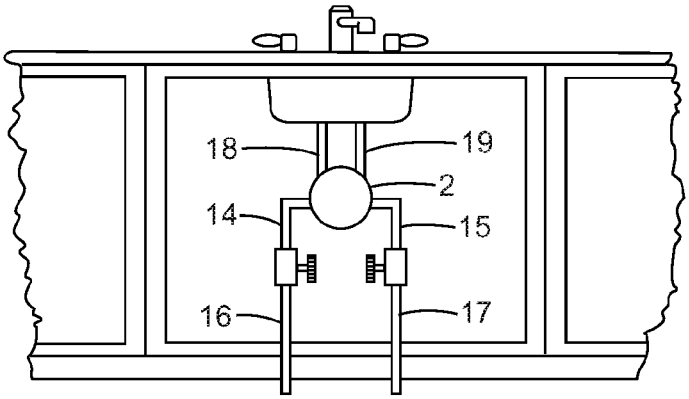
FIG. 5 is a schematic diagram of the valve installation under the sink.

During normal convective circulation flow with both hot and cold faucets closed, hot water will enter two-way check/bypass valve 2 from existing hot water standpipe, 16, as shown in FIG. 5. The hot water will flow through hot water connector 14, past open hot water valve poppet 11 into cavity 3, over to and past open cold water poppet 13 to cold water connector 15, and through an existing cold water standpipe, 17, and back to water heater 1. The circulation flow rate is controlled by the flow area through the check valves to about 220 cubic centimeters per minute, a flow level sufficient to maintain water at the faucet in the range of 105° to 110° F. with a heater outlet water temperature of 125° F. These temperatures are illustrative and are not a limitation, as they can be varied.

Water will flow freely to the faucets through two-way check/bypass valve via flow paths 8 and 9 any time a faucet is open. When either faucet is opened the water pressure will drop in the line to the faucet causing the poppet to move up to the valve seat stopping the circulation flow, and precluding any unwanted mixing of hot and cold water supplied to the faucets. This closure assures that the full range of water temperature is available at each faucet. When the faucet is closed the pressure differential is eliminated, the closed poppet will move away from the valve seat allowing the circulation flow to resume. The unit is to be installed in the upright position as shown in FIG. 5; however, it will function well even if mounted at an angle from the vertical.

While the apparatus, system, and method have been described with reference to various embodiments, those skilled in the art will understand that various changes may be made and equivalents may be substituted for elements thereof without departing from the scope and essence of the disclosure. In addition, many modifications may be made to adapt a particular situation or material in accordance with the teachings of the disclosure without departing from the essential scope thereof. Therefore, it is intended that the disclosure not be limited to the particular embodiments disclosed, but that the disclosure will include all embodiments falling within the scope of the appended claims. In this application all units are in the English system and all amounts and percentages are by weight, unless otherwise expressly indicated. Also, all citations referred herein are expressly incorporated herein by reference.

I claim:

1. A convective hot water circulation system, consisting essentially of:

(a) a water heater to generate a flow of hot water to one or more hot water taps in flow communication with the water heater through one or more hot water distribution lines;

(b) a flow of cold water into the water heater;

(c) a flow of cold water in a cold water distribution line to water taps located in adjacency to the hot water taps; and (d) a two-way check/bypass valve assembly interposed between one of the hot distribution lines and one of the cold water distribution lines, the two-way check/bypass valve comprising:

(i) a valve body;

(ii) a hot water flow in the valve body to the designated hot water tap;

(iii) a cold water flow in the valve body to a designated cold water tap located in adjacency to the designated hot water tap;

(iv) a hot water poppet and valve seat pair;

(v) a cold water poppet and valve seat pair; and (vi) a cavity within the valve body permitting the hot water flow into the valve body to flow into the cold water flow to the valve body when both the hot water tap and the cold water tap are closed.

2. The convective hot water circulation system of claim 1, wherein the two-way check/bypass valve assembly has a threaded cold-water inlet connector, a threaded cold-water outlet connector, a threaded hot water inlet connector, and a threaded hot-water outlet connector.

3. The convective hot water circulation system of claim 2, wherein a flexible hose is connected between the valve assembly threaded cold-water inlet connector and the flow of cold water to the cold water tap; and a flexible hose is connected between the valve assembly threaded hot water inlet connector and the hot water distribution line.

4. An installation kit for creating a convective hot water circulation system including a water heater to generate a flow of hot water to one or more hot water taps in flow communication with the water heater through one or more hot water distribution lines, a flow of cold water into the water heater; and a flow of cold water in a cold water distribution line to water taps located in adjacency to the hot water taps, consisting essentially of:

(a) a two-way check/bypass valve assembly interposed between one of the hot distribution lines and one of the cold water distribution lines, the two-way check/bypass valve comprising:

(i) a valve body;

(ii) a hot water flow in the valve body to the designated hot water tap;

(iii) a cold water flow in the valve body to a designated cold water tap located in adjacency to the designated hot water tap;

(iv) a hot water poppet and valve seat pair;

(v) a cold water poppet and valve seat pair; and (vi) a cavity within the valve body permitting the hot water flow into the valve body to flow into the cold water flow to the valve body when both the hot water tap and the cold water tap are closed; and (b) a pair of flexible hoses for connecting the valve assembly to a hot water distribution line and a cold water distribution line.

5. The installation kit of claim 4, wherein the two-way check/bypass valve assembly has a threaded cold-water inlet connector, a threaded cold-water outlet connector, a threaded hot water inlet connector, and a threaded hot-water outlet connector.

6. The installation kit of claim 5, wherein the first flexible hose connects the valve assembly threaded cold-water inlet connector to the cold water distribution line; and the second flexible hose connects between the valve assembly threaded hot water inlet connector and the hot water distribution line.

* * * * *